United States Patent [19]

Buresi et al.

[11] 4,188,084

[45] Feb. 12, 1980

[54] UNDERWATER ELECTRICAL CONNECTORS

[75] Inventors: Georges Burési, Versailles; Rene G. Grappé, Paris, both of France

[73] Assignee: Compagnie Francaise des Petroles, Paris, France

[21] Appl. No.: 961,829

[22] Filed: Nov. 17, 1978

[30] Foreign Application Priority Data

Nov. 21, 1977 [FR] France ..... 77 34855

[51] Int. Cl.[2] ..... H01R 3/04

[52] U.S. Cl. ..... 339/117 R; 339/16 R

[58] Field of Search ..... 339/117 R, 117 P, 18 P, 339/118 R, 16 R, 143 R

[56] References Cited

U.S. PATENT DOCUMENTS

| | | | |
|---|---|---|---|
| 3,839,608 | 10/1974 | DeVries | 339/117 R X |
| 3,877,775 | 4/1975 | Barlow et al. | 339/117 R |
| 4,050,765 | 9/1977 | Duesterhoeft et al. | 339/117 R |

*Primary Examiner*—Roy Lake
*Assistant Examiner*—DeWalden W. Jones
*Attorney, Agent, or Firm*—Sughrue, Rothwell, Mion, Zinn and Macpeak

[57] ABSTRACT

An electrical connector for effecting connection between groups of submerged electrical contact elements comprises a plug and a base, each provided with electrical contact elements to be connected and which are immersed in an insulating liquid in respective enclosures in the plug and base, one of the enclosures being annular and inwardly limited by an inner protective body and the other of the enclosures being cylindrical and outwardly limited by an outer protective body. The plug and base are connected by sliding the cylindrical enclosure over the surface of the annular enclosure so as to replace the inner protective body by the cylindrical enclosure and to bring the electrical contact elements into alignment.

19 Claims, 6 Drawing Figures

76
70
68
77
75
65
66
69
71
72
75
68
60
74
61
78
62
63
67
64
73
79

UNDERWATER ELECTRICAL CONNECTORS

The invention relates to an electrical connector for joining one or more groups of electrical contact elements, which are located underwater, for example at the bottom of the water and are electrically connected to underwater electrical equipment, for example underwater oil-well equipment, to corresponding electrical contact elements on a movable plug which is, for example, connected by means of a cable to control circuits arranged at the surface of the water and is capable of being raised to the surface and then lowered again in order to be reconnected, without the use of divers.

A connector of this kind, which is capable of providing effective protection for the or each submerged group of electrical contact elements in order to subsequently receive a group which is lowered from the surface and is capable of being connected thereto by a simple movement, has not apparently yet been proposed.

According to the invention there is provided an electrical connector for underwater connection of groups of electrical contact elements, comprising a movable plug carrying a group of electrical contact elements and a base carrying a group of electrical contact elements to be connected to said elements of said plug, wherein said contact elements of said plug and said contact elements of said base are immersed in insulating liquid contained respectively within two complementary enclosures, one of said enclosures being annular and inwardly limited by an inner protective body and the other said enclosure being cylindrical and outwardly limited by an external protective body, said cylindrical enclosure being adapted to slide relatively over the surface of said annular enclosure so as to replace said inner protective body by said cylindrical enclosure and to place corresponding contacts opposite one another.

Preferably the group of electrical contact elements in the base is arranged in an annular cylindrical body which is bordered internally by a movable inner protective cylinder, the base being filled with an insulating oil, and the electrical contact elements in the plug are arranged in a movable inner cylindrical body which is bordered externally by an outer protective cylinder filled with insulating oil. The pushing of the inner cylindrical body of the plug into the annular body of the base causes movement of the inner protective cylinder of the base and the bringing into contact of the corresponding electrical contact elements in the base with those in the plug.

Therefore, when the plug is withdrawn from the annular body of the base, it suffices to simultaneously raise the inner protective cylinder of the base to protect the contact elements in the base, so that the contact elements continue to be bathed by the insulating oil, with the result that the base can remain under water for a long period without being connected to the plug.

To improve the protection of the contact elements in the plug and in the base, by avoiding the introduction of foreign bodies when the plug is introduced into the base, oil under pressure may be injected between the base/plug interfaces comprising the outer end surface of the inner protective cylindrical body of the base and the outer end surface of the cylindrical body carrying the contact elements in the plug.

Debris which may accumulate on the outer end surface of the inner protective cylinder of the base can thus be discharged before the base/plug contact surfaces meet and before the contact elements join, with the result that there is no danger of a foreign body being introduced into the insulating oil and hence between the contact elements.

To increase the number of connecting elements for a given volume of the connector, the elements may be divided up into groups arranged in axially spaced radial planes. The contact elements in the plug may be laterally movable to operative positions and, to that end, may be acted upon by common cam means causing the simultaneous lateral movement of all the contact elements in the plug over contact surfaces of the contact elements in the base.

Thus, a simple remote-control signal actuating cam means comprising, for example, m superposed frusto conical elements, each frusto conical element engaging n contact elements in the plug, suffices to connect mn circuits.

To facilitate the control of the connecting and disconnecting processes in deep water, flexible chambers may be provided inside the insulating liquid filled enclosures of the plug and the base, and the chambers being in communication with the outside. To facilitate the disconnection, in an emergency, a safety control may be provided which requires only a simple pull on the plug to cause the lateral withdrawal of all the contact elements and the separation of the plug from the base.

In this way, a flexible electrical connector can be produced which is adapted to underwater conditions in deep water and to use by means of remote-controlled signals from a surface platform, it being possible for the connecting plug to be easily guided, during its lowering or raising, by any known means, the connection being effectively made regardless of debris which accumulates on the bottom and regardless of the depth.

The invention will be more fully understood from the following description of an embodiment thereof given by way of example only, with reference to the accompanying drawings.

Figure 4:
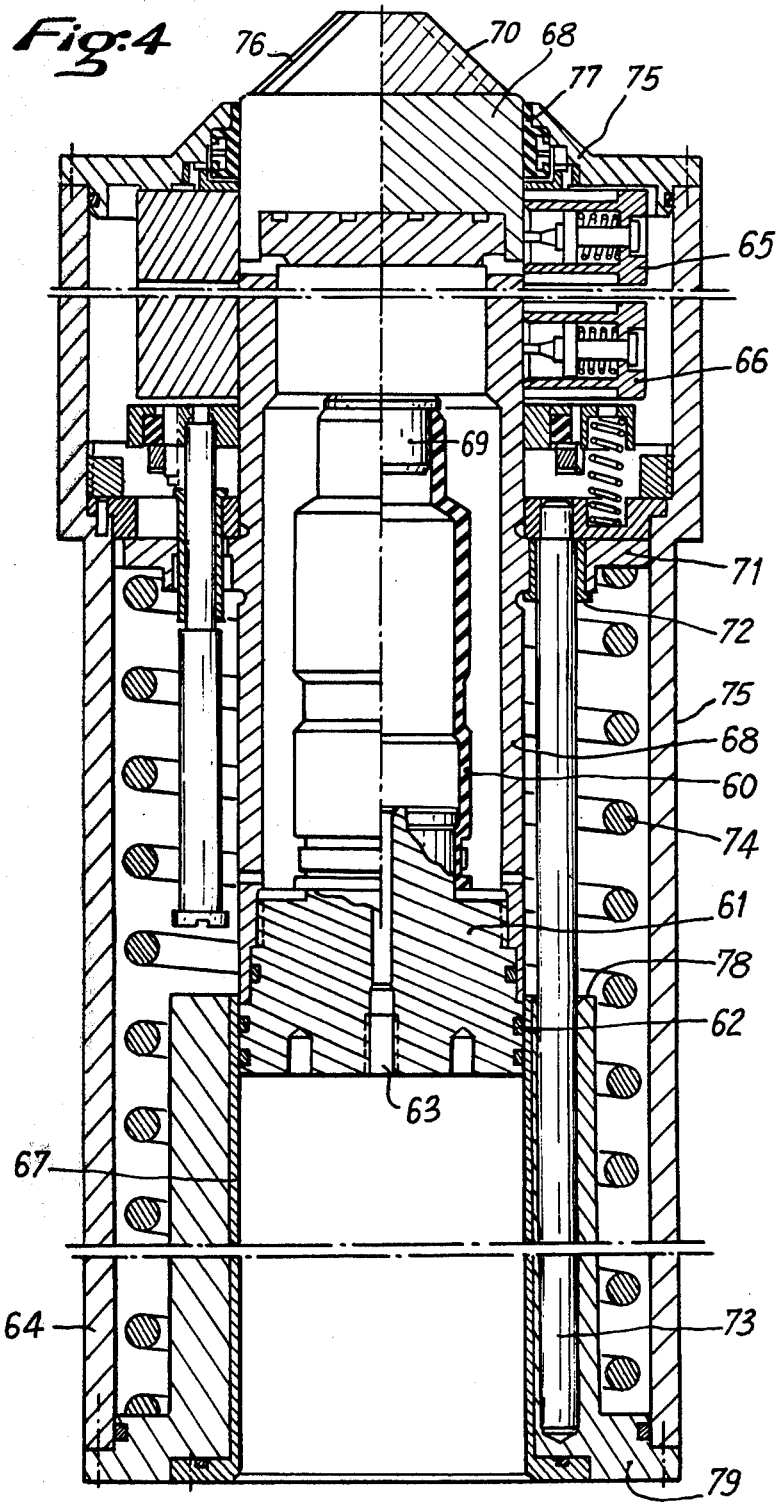
FIG. 4 is a schematically representation of the base of the connector in axial section.

The electrical connector shown in the drawings comprises a first part or plug which is shown in FIGS. 1 to 3 and 5 and a second part or base which is shown in FIG. 4.

Figure 1:
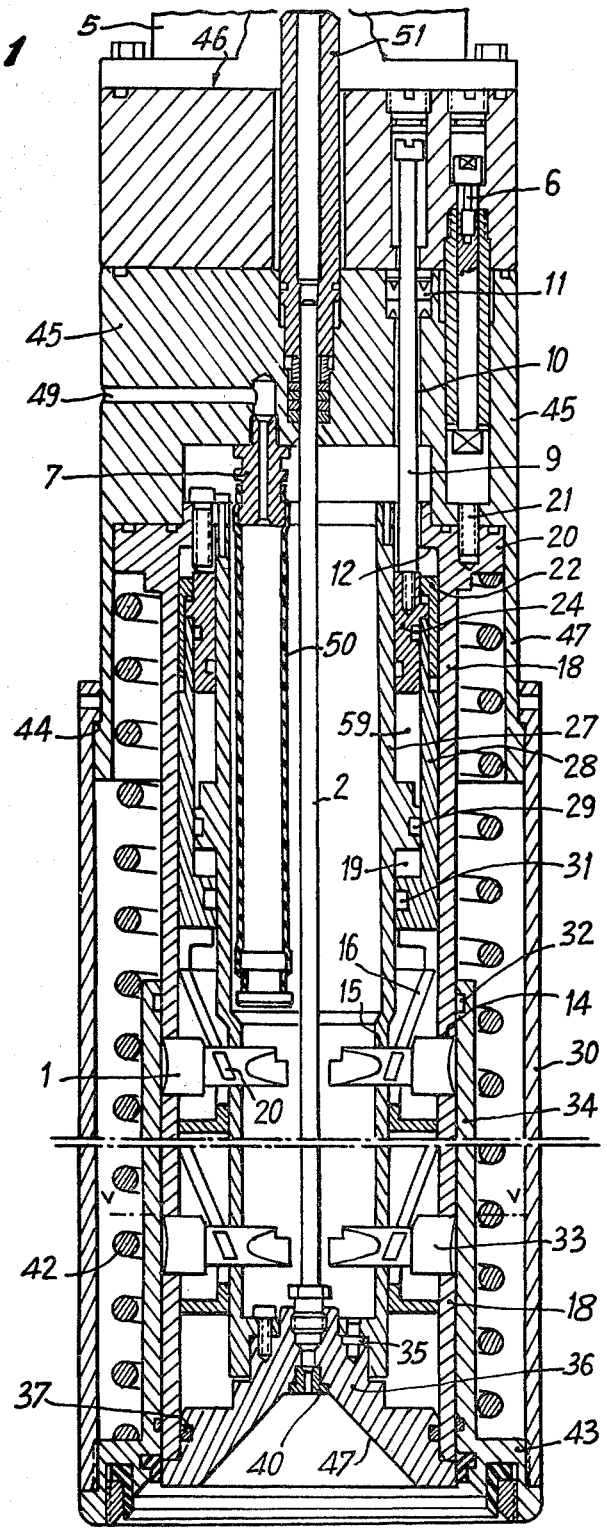
FIG. 1 is a simplified sectional view of a plug of an embodiment of a connector according to the invention, in axial section along the line I—I of FIG. 3.
Figure 2:
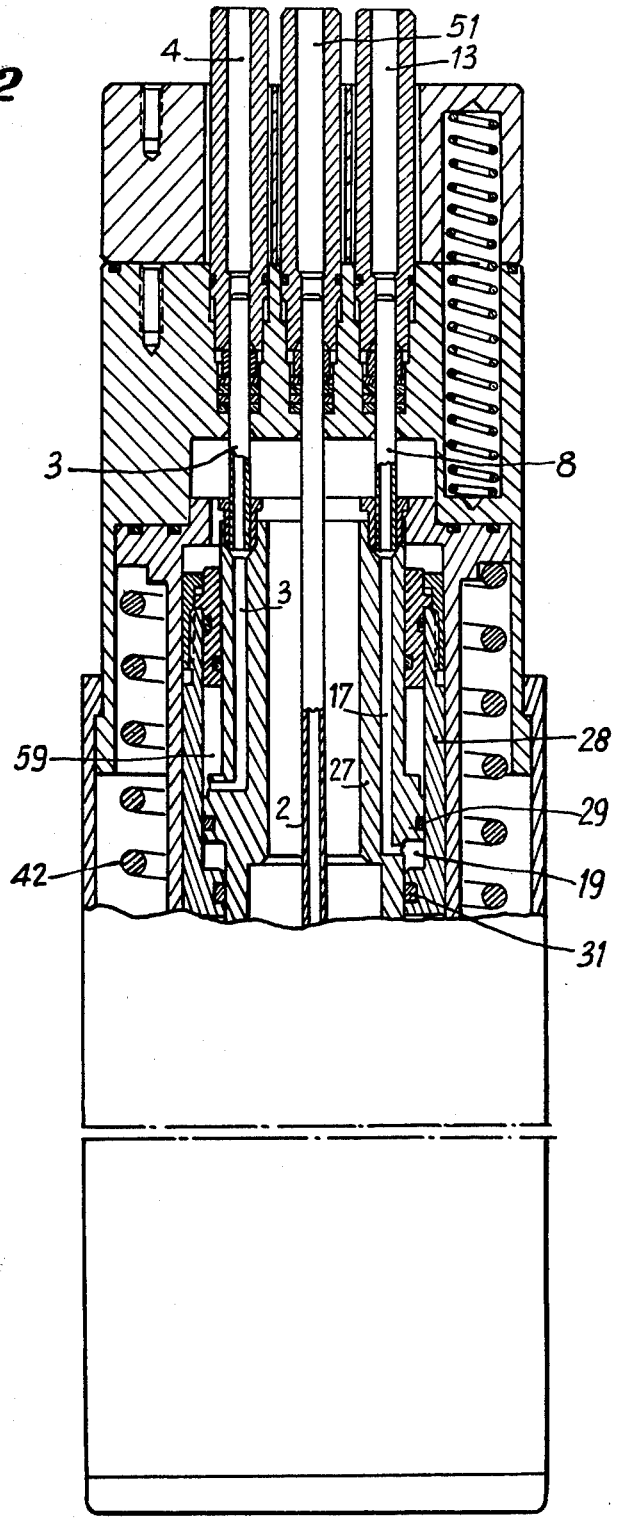
FIG. 2 is a simplified view of the upper part of the plug of FIG. 1, in section along the line II—II of FIG. 3.
Figure 3:
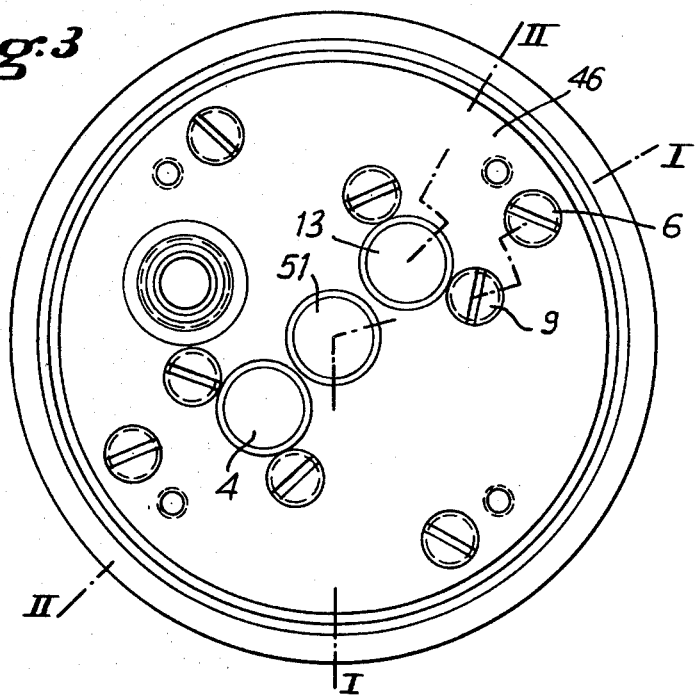
FIG. 3 is a simplified view of the upper end face of the plug of FIG. 1.
Figure 5:
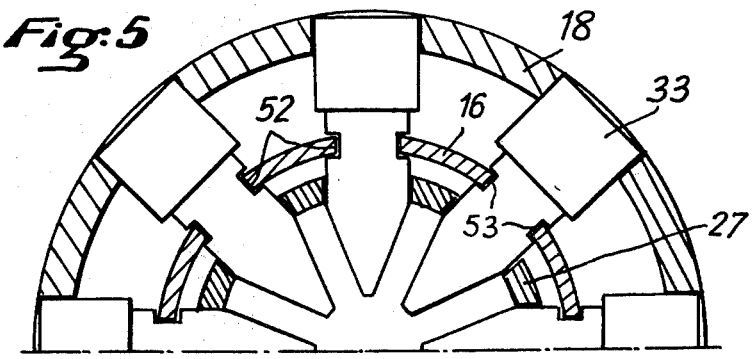
FIG. 5 is a partial section along the line V—V of FIG. 2.

For greater clarity, FIG. 1 of the drawings shows only the housings of the contact elements of two annular groups in the plug, namely housings 33 (FIGS. 1 and 5) of the electrical contact elements nearest the head 36 of the plug, and housings 1 of the contact elements furthest from the head of the plug. Each housing 1 and 33 is slidable in openings 14 in an outer cylindrical support 18 and in openings 15 in an inner cylindrical support 27. Each housing cooperates with a frustoconical cam element 16 (FIGS. 1 and 5) which is fast with a cylindrical member 28 for controlling radial sliding movement of the housings 1 and 33. Member 28 forms a jack in cooperation with the support 27. For this purpose, the support 27, in FIG. 2, is provided with a channel 17 which is connected to a circuit 8 for supply of oil through a connector piece 13. The channel 17 opens into a chamber 19 between member 28 and support 27 which is rendered leaktight by a gasket 31 on the control member 28 which slides on the outer surface of the support 27, and by a gasket 29 on the support 27 over which the inner surface of the control member 28 slides. In the position shown in FIG. 1, the conical cam elements 16 maintain all the contacts in the positions shown. The interior of the plug is filled with an insulating oil which bathes the contact elements and is retained in the plug by means of gaskets such as gasket 37 positioned on the conical head 36, and gasket 32 located on a sheath 34 for protecting the contact elements in the housings 1 and 33. A membrane 50, forming a pocket within the support 27, is fixed to a tube 7 which is connected to a channel 49 in the upper part 45 of the plug and which opens to the exterior of the plug. The oil bathing the electrical contact elements in the housings 1 and 33 is thus at atmospheric pressure.

The conical head 36 is fixed to the supports 18 and 27 by any suitable means, for example bolts 35. The sheath 34 is biased axially downwardly by a spring 42 which is compressed between a flange 20 on the upper end of the support 18 and a flange 43 on the lower end of the sheath 34. The downward movement of the sheath is limited by a housing member 30, the lower end of which is fast with the flange 43, which has a shoulder 44 at its upper end which comes to bear against a corresponding shoulder on a skirt 47 of the upper part 45 of the plug. The assembly 45-27-18-36 can thus move relative to the housing member 30 when a force is exerted on the upper end surface 46 of the plug, the housing member 30 remaining stationary with the skirt 47 of the part 45 sliding into the member 30, and the support 18 sliding over the gaskets 32 on the stationary sheath 34.

The base of the connector is shown in FIG. 4 and comprises a socket 64 comprising, in its upper part, annular groups of contact element housings, such as 65 and 66, and in its lower part a cylinder 67. The groups of contact elements are bathed in insulating oil and are protected inside the socket 64 by a piston 68. A mandrel 69, supporting a membrane 60, connects the protective piston 68 to a guide piston 61 which slides in the cylinder 67 and carries gaskets 62 sealing the interior of the socket from the exterior. A channel 63 extends through the piston 61 and opens at an external surface of the mandrel 69, so as to allow water to penetrate between the membrane 60 and the mandrel 69. The fixings of the ends of the membrane 60, which is in the form of a sleeve, can be of any type and have not been shown.

To uncover the contact elements 65 and 66, the protective piston 68 is displaced by pressure exerted by the conical head 36 of the plug on the end of piston 68. The end of the piston 68 is provided with a conical surface 70 matching the conical surface 47 of head 36 and to be engaged thereby. Whilst it is being pressed into the socket 64, the flange 71 on the median part of the piston 68 carry along guide sockets 72, which slide on columns 73 fixed to a plinth 79, and moreover compress a spring 74, the ends of which rest respectively on the flange 71 and the plinth 79.

For greater clarity, the drawings do not show the electrical connections of the contact elements in the movable housings 1 and 33 of the plug, or those of the contact elements in the fixed housings 65 and 66 of the base, it being possible for the connections of the circuits of the contact elements in the housings 1 and 33 to a cable of the plug and those of the contact elements in the housings 65 and 66 to underwater equipment cables to be of any type and to terminate, by any desired paths, on any given part of the plug and of the base.

Figure 6:
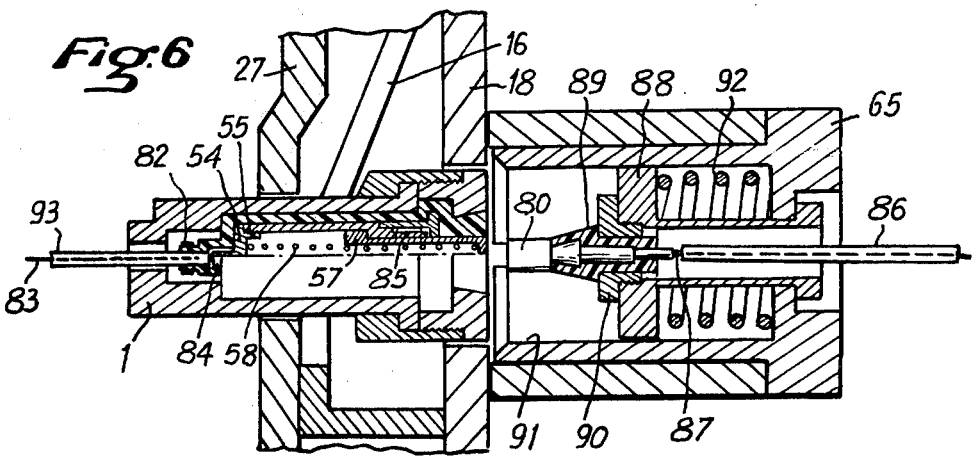
FIG. 6 is a simplified section of a pair of contact elements.

As regards the contact elements, they may be of any suitable type. By way of example and according to a preferred embodiment, the contact elements of the movable housings 1 and 33 of the plug are sockets 54, FIG. 6, which receive the fixed contact elements, in the form of pins 80, in the base. The electrical contacts are established by sliding the sockets over the pins, with a certain amount of rubbing in order to remove any film of insulating oil.

When it is desired to couple the surface circuits to the underwater circuits which are coupled to the contact elements in the base located on an underwater installation, the plug joined to its cable is lowered from the surface, the cable being simultaneously unrolled from the surface. The plug is guided by any known means, e.g. a line, rails or a guiding tool, to bring the conical head 36 of the plug opposite the conical surface 70 of the piston 68. The lower end surface of the sheath 34 which is generally frusto conical comes opposite a correspondingly frusto conical surface on the upper part 75 of the socket 64 of the base. Oil under pressure is then injected through a channel 2, which extends from the connecting piece 51, and spurts from a nozzle 40 so as to sweep the conical surface 70 of the piston 68 and also the frusto conical surface of the upper part 75 of the socket 64. After removal of any debris between the plug head and the base, it suffices to continue the approaching movement until the conical surfaces 47 and 70 engage, whilst still injecting oil, in order to effect the join, and then to continue the penetration of the head 36 together with the supports 27 and 18 of the housings 1 and 33 of the contact elements, into the bore of the upper part 75 of the socket 64. No water is taken in during this movement.

In order to achieve exact coincidence of the contact elements in the plug with the contact elements in the base, the conical surfaces 47 and 70 may be provided with corresponding ribs and grooves, for example 76 for the surface 70, which make it possible to increase the precision of the positioning operations.

The penetrating movement of the head 36 of the plug into the bore 75 is continued, without the penetration of water, by virtue of gaskets 77 at the periphery of the bore 75. During this movement, the housings 1 and 33 move out of engagement with the sheath 34, whilst the protective piston moves away from the groups of housings 65 and 66 of the base.

At the end of the movement, the sockets 72, which are fixed relative to the piston 68 of the base, come to rest against the upper part 78 of the plinth 79, the housings 1 and 33 being then opposite the housings 65 and 66. Oil under pressure is then supplied to the chamber 19 in the plug to move the member 38 and therefore the cam elements 16 downwardly. As can be seen more clearly in FIG. 5, the edges 52 of the elements 16 cooperate with grooves 53 in the housings 1 and 33. Since they are no longer protected by the sheath 34, the housings 1 and 33 move laterally outwardly and simultaneously in order to partially penetrate into bores 91 of the housings 65 and 66 and optionally push back pin-holders 88 which are acted upon by springs 92.

In order to ensure perfect contact between the electrical contact elements in the housings in the base, a part 85 of the socket 54, which, at the end of the lateral movement, presses against the cylindrical surface of the pin 80, is protected by an inner protective jacket 57 which is acted upon by a spring 58. Furthermore, the part 85 forms an elastic ring so that it perfectly matches the pin 80. When the end of the protective jacket 57 comes to rest against the end of the pin 80, the continued lateral displacement of the housing 1 forces the end of an outer insulating protective case 55 of the socket 54 to match and slide firstly over the cylindrical surface of the pin 80, and then over the conical surface of the insulating case 89 for protecting the body of the pin 80. The elastic ring 85, which is gradually uncovered by the holding back of the case 57, thus presses on the cylindrical part of the pin 80 which has now been swept by the end of the case 55, with the result that the connection is established without trapping any insulating oil. In the example shown in FIG. 6, a conductive wire 83 is welded at 84 to the socket 54, a wire 86 being welded at 87 to the terminal part of the pin 80, which is trapped, together with its insulating case 89, in a retaining piece 90 and the guide support 88 which is acted upon by the spring 92. When the housing 1 is retracted, the contact ring 85 slides gradually from the pin 80 on to its insulating protective jacket 57, the end of the outer insulating case 55 similarly leaving the case 89 and then the pin 80, to bear again on the jacket 57. In this example, in which the conductive wire 83 can move with the housing 1, the case 93 of the wire 83 is surrounded by the end of the case 55, which is held on the wire by means of a spring clip 82.

During disconnection, the displacement of the conical elements 16 in the opposite direction is controlled by injecting oil into a chamber 59 through a channel 3 which is connected to the connecting piece 4, the oil in the chamber 19 being discharged. Thus, the housings 1 and 33 of the contact elements are caused to retract. In order to raise the plug, it suffices to exert a pull on the upper part 46 of the plug, for example using pulling means represented schematically by 5. During this upward displacement, the head 36 is gradually brought back to the position shown in FIG. 2, whilst the piston 68 re-covers the housings 65 and 66 of the contact elements in the base under the action of the spring 74, the contact elements in the housings 1 and 33 of the plug being similarly protected by the sheath 34.

In the case where the hydraulic circuit fails to function, it is still possible to raise the plug of the connector to the surface solely by a pull exerted at the upper part 46 of the plug, for example by the means 5.

In this case, the ends of the housings 1 and 33 are still in the housings 65 and 66 and consequently the plug is held in the bore of the socket 64, the pull on part 46 has the effect of breaking pins 6 which hold the part 46 to the support 18 by means of an assembly 21. Consequently, the part 46 is detached from the part 45. A piston 24 is provided which is fast with the control member 28 and is connected to a rod 9 which extends through a passage 10 and a gasket in the part 45. The head of the rod 9 is located in part 46. Movement of part 46 away from part 45 exerts a pull on the rod 9 and therefore on piston 24 and control member 28. The displacement of the control member 28 causes the retraction of the housings 1 and 33. At the end of this displacement a member piece 22 comes into abutment with a shoulder 12 on flange part 20 of the support 18, with the result that the head 36 is retracted from the base.

Although only a single preferred embodiment of a connector has been described, it will be understood that numerous modifications could be applied to the various structures described, without going outside the scope of the present invention, it being possible, for example, for each control means to be replaced by equivalent means. It would also be possible to substitute other equivalent electrical contact elements, replace the movable housings which are internal relative to the base, when the latter is connected to the plug, by movable housings which are external relative to the base, and even substitute the terminals in the base for the sockets in the plug.

What is claimed is:

1. An electrical connector for underwater connection of groups of electrical contact elements comprising:

a movable plug carrying a group of electrical contact elements;

a base carrying a group of electrical contact elements to be connected to the elements of said plug;

an enclosure in each of said plug and base filled with insulating liquid in which the respective said electrical contact elements are immersed, one of said enclosures being annular and the other of said enclosures being cylindrical;

an inner protective body inwardly limiting said annular enclosure; and an outer protective body outwardly limiting said cylindrical enclosure, wherein said cylindrical enclosure is adapted to slide relatively over the surface of said annular enclosure so as to replace said inner protective body from said cylindrical enclosure and to place corresponding ones of said electrical contacts opposite one another.

2. A connector as claimed in claim 1, in which said plug comprises said cylindrical enclosure and said base comprises said annular enclosure, and said contact elements in said cylindrical enclosure are movable laterally thereof to operative positions.

3. A connector as claimed in claim 1, in which said contact elements in one of said enclosures are movable laterally thereof to operative positions.

4. A connector as claimed in claim 2, in which said contact elements in said two enclosures are arranged in axially spaced parallel planes, and said movable contact elements have housings provided with means cooperating with guide means controlled by a single control mechanism.

5. A connector as claimed in claim 4, in which said guide means comprise the edges of openings provided in superposed conical elements.

6. A connector as claimed in claim 5, in which said lateral displacement of said movable contact elements is controlled by the axial displacement of the conical elements.

7. A connector as claimed in claim 6, in which said conical elements are connected for displacement to jack means.

8. A connector as claimed in claim 7, in which said jack means are adapted to return said movable contact elements to their original retracted positions.

9. A connector as claimed in claim 7, in which said annular enclosure defines a chamber having a flexible wall in contact with said insulating liquid and which communicates with the outside.

10. A connector as claimed in claim 9, in which said cylindrical enclosure defines a chamber having a flexible wall in contact with said insulating liquid and which communicates with the outside.

11. A connector as claimed in claim 6, in which said cylindrical enclosure comprises an end member which is movable relative to the body defining said enclosure, and a stop for transmitting motion of the end member to said body of said enclosure after a given movement of said end member, said end member being connected to the said conical elements such that said contact elements in said cylindrical enclosure are moved to their retracted positions by a pull exerted on said end member which successively causes the displacement of said end member relative to said body of the enclosure, the movement of said stop, the retraction of said movable contact elements and the separation of said plug and base.

12. A connector as claimed in claim 2, in which said movable contact elements comprise sockets and said other contact elements to be connected thereto comprise electrical pins, the lateral displacement of said movable contact elements causing electrical contact between said sockets and said pins.

13. A connector as claimed in claim 12, in which each of said pins is mounted on a support which is slidable in a fixed housing.

14. A connector as claimed in claim 12, in which each of said sockets of said movable contact elements is internally covered by a relatively movable protective jacket.

15. A connector as claimed in claim 14, including a case for externally protecting each said socket of said movable contact elements which borders and extends beyond the end of said socket.

16. A connector as claimed in claim 15, in which the end of each said protective case bordering the end of said socket has an extension with an inner cylindrical surface which matches and is adapted to sweep the surface of said corresponding pin before said socket and said pin come into contact during the lateral displacements of said movable contact elements.

17. A connector as claimed in claim 16, in which each said socket comprises an elastic ring, the inner edge of which serves as a stop for said movable protective jacket which is acted upon by a spring, said jacket extending beyond the outer end of said socket.

18. A connector as claimed in claim 17, in which each said pin has a free cylindrical surface, the end of which serves as a stop for said pretective jacket of said corresponding socket.

19. A connector as claimed in claim 18, in which said cylindrical surface of each said pin is adjacent a conical surface of a protective case thereof.

* * * * *